United States Patent [19]

Peterson

[11] 4,039,154

[45] Aug. 2, 1977

[54] REFINING ELEMENT

[75] Inventor: Per Viking Peterson, Sundsvall, Sweden

[73] Assignee: SCA Development Aktiebolag, Sundsvall, Sweden

[21] Appl. No.: 663,539

[22] Filed: Mar. 3, 1976

[30] Foreign Application Priority Data

Mar. 12, 1975 Sweden ..... 7502787

[51] Int. Cl.[2] ..... B02C 7/08; B02C 7/12

[52] U.S. Cl. ..... 241/261.3; 241/296

[58] Field of Search ..... 241/261.2, 261.3, 296, 241/297, 298

[56] References Cited

U.S. PATENT DOCUMENTS

| | | | |
|---|---|---|---|
| 2,035,994 | 3/1936 | Sutherland, Jr. | 241/261.3 X |
| 2,156,321 | 5/1939 | Sutherland, Jr. | 241/298 X |
| 2,654,295 | 10/1953 | Sutherland | 241/296 X |
| 2,776,800 | 1/1957 | Uschmann | 241/296 |
| 3,149,792 | 9/1964 | Textor | 241/261.3 |
| 3,815,834 | 6/1974 | Gilbert | 241/296 X |
| 3,910,511 | 10/1975 | Leider et al. | 241/261.3 |

*Primary Examiner*—Roy Lake
*Assistant Examiner*—Howard N. Goldberg
*Attorney, Agent, or Firm*—Lerner, David, Littenberg & Samuel

[57] ABSTRACT

Refining elements for use in the refining of fibrous materials, such as cellulose pulps and the like, are disclosed. Specifically, the refining elements disclosed comprise a pair of refining zones disposed in a direction of flow of the fibrous materials through the refining element, both refining zones including both grooves and ridges on the face thereof, and specifically wherein the ratio of the width of the grooves to the width of the ridges in the first refining zone is greater than the ratio of the width of the grooves to the width of the ridges in the second refining zone. Preferably, the number of ridges in the second refining zone is less than that in the first refining zone, and at least three such refining zones may also be included in the refining element.

6 Claims, 6 Drawing Figures

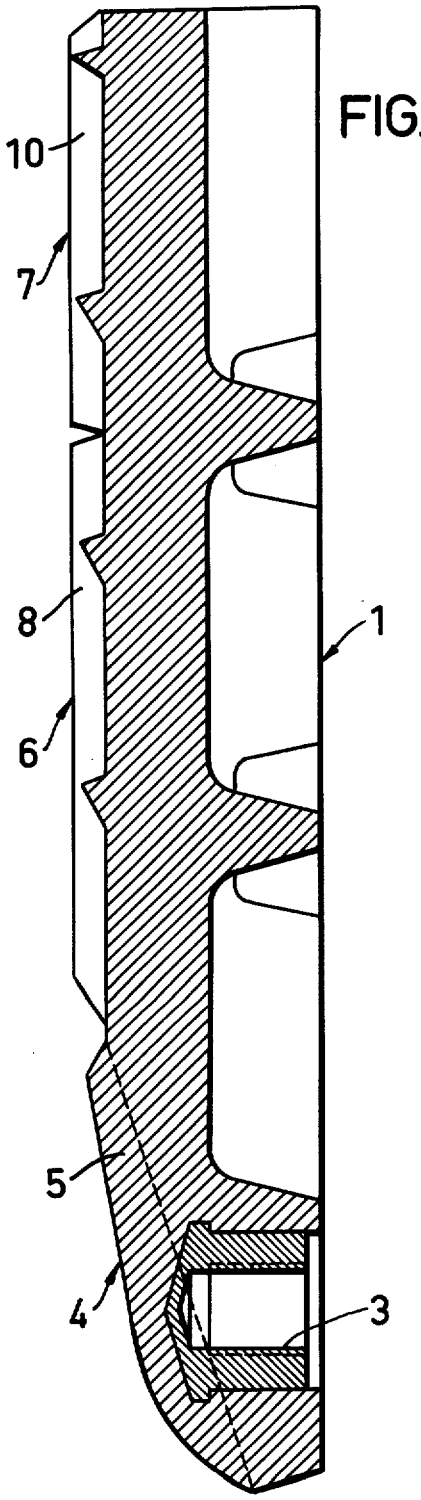
FIG. 3
FIG. 4
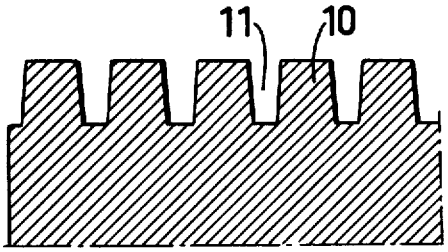
FIG. 5
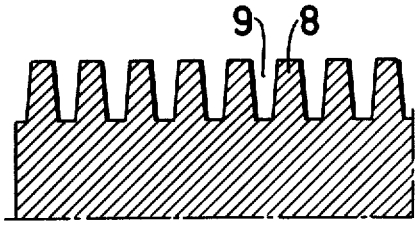
FIG. 6
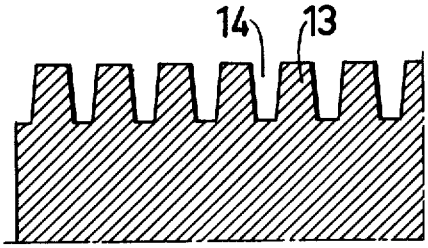

REFINING ELEMENT

FIELD OF THE INVENTION

The present invention relates to refining elements, particularly for use in the refining of various fibrous materials. In particular, the present invention is specifically directed to such refining elements for refining cellulosic and mechanical pulps of various types. Still more specifically, the present invention is directed to such refining elements including working faces which preferably rotate with respect to each other to obtain such refining.

BACKGROUND OF THE INVENTION

It is known that wood chips, possibly pretreated by heat and/or chemicals, are defibered by so-called refiners. These refiners, however, are also utilized for refining cellulose and mechanical pulps of various types when the paper-forming properties of these materials are to be developed by mechanical treatment. All such defibering or refining have in common the desired mechanical treatment of the fibrous material during its passage through the refiner. This treatment is effected upon the fibrous material, after it is fed into the refiner, by various means, whereby it leaves the refiner through a narrow gap between two working surfaces, which for this purpose are generally provided with working means in the form of ridges and intermediate grooves. Due to the rotation of one and, at times, both of said surfaces, the material is worked in the desired manner and transported out of the refiner by the forces of rotation. These refiners are generally of the disc-refiner type, but other types of refiners, such as the so-called conic refiners can also be used.

The intensity and kind of the treatment of the fibrous material is generally determined by the appearance or nature of the ridges and grooves on the working surfaces, and by the size of the gap therebetween. A certain gradual wear of the refining surfaces is unavoidable. For practical reasons, therefore, a disc refiner must be equipped with exchangeable refining elements, which are exchanged after a certain time when that wear has proceeded to a degree wherein it gives rise to process disturbances, or when the refining results are no longer satisfactory. The refining elements are also manufactured with a pattern and section in accordance with the kind of work to be carried out in the refiner. The energy transfer from these refining elements to the fibrous material is partly effected via the edges of the ridges and partly via the upper surfaces of the ridges.

The ridges, thus result in the fibrous material being subjected to compression and shearing forces. The highest compression forces are thus brought about when the material is clamped between the edges of the ridges, while the shearing forces are high when the material is rubbed between the surfaces of the ridges.

When these materials have disintegrated to fibrous level, i.e. when the fibers are exposed, the compression forces are most active. In order to develop the paper-forming properties of the exposed fibers, a further treatment of the fibers is required. The object of this treatment is to split up or delaminate the exposed fibers. This treatment is best effected by shearing forces, beacause too high compression forces at this stage easily cause the fibers to break off, whereby the paper-forming properties of the refined material substantially deteriorate.

In the past, various refining element surfaces have been disclosed. Thus, U.S. Pat. NO. 2,156,321 to Sutherland, Jr. discloses a fiber pulp refiner which principally employs a yielding or elastic surface, such as rubber. In addition, however, irrespective of the composition of these refining elements, the patentee discloses the use of distinct annular zones, such as those shown in FIGS. XI and XII. In particular, the patentee employs grooves which diminish in depth on the sharper outward paper then the portions of the grooves inside such zones. This may be seen in FIG. IX, for example.

Furthermore, U.S. Pat. No. 3,240,437 to Horstman discloses another refiner plate which, as shown in FIGS. 2 and 3, also employs convergent closely spaced bars 38. These bars increase in depth as one approaches the extremity of the plate. This is intended to relieve the compressive forces as they flow outwardly from the plates 25.

Finally, U.S. Pat. No. 2,035,994 to Sutherland, Jr. discloses yet another fiber refiner, and with particular reference to FIG. X thereof, again shows various annular sections on each refining element thereof. This patentee again discloses the diminution of the effective area and width of passage for the stock and its fibrous particals as they pass outwardly through these sections, such as by reducing the cross section and depth of the flow grooves thereof.

Each of these known refining surfaces have therefore proved deficient with respect to the above-noted objectives. It is therefore the object of the present invention to overcome these and other difficulties in prior art refining elements.

In particular, the present invention therefore teaches a refining element which in refining fibrous material yields a distribution of compression and shearing forces which is highly favorable for the paper-forming properties thereof.

According to the invention, it is therefore possible in a one-step refining process to achieve a pulp which is ready for paper-making.

The characterizing features of this invention will become apparent from the appended claims.

BRIEF DESCRIPTION OF THE DRAWINGS

The invention is more fully described below, with reference to the accompanying drawings, in which:

FIG. 3 shows a cross sectional side view of the refining element of FIG. 1, taken along section 3—3 thereof:

FIG. 4 shows a sectional side view of the refining element of FIGS. 1 and 2, taken along sections 4—4 thereof;

FIG. 5 shows a sectional side view of the refining elements of FIGS. 1 and 2, taken along sections 5—5 thereof; and FIG. 6 shows a sectional side view of the refining element of FIG. 2, taken along section 6—6 thereof.

SUMMARY OF THE INVENTION

In accordance with the present invention, these and other objects are accomplished by means of a refining element for refining such fibrous materials comprising a plurality of refining zones, including a first refining zone and a second refining zone disposed in the direction of flow of the fibrous material through the refining element. Both the first refining zone and the second refining zone include refining element surfaces comprising both ridges and intermediate grooves. The ratio of the width of the grooves in the first refining zone to the width of the ridges in the first refining zone is greater than the ratio of the width of the grooves in the second refining zone to the width of the ridges in the second refining zone. For the purposes of this invention, the width of the grooves is measured at the top of the ridges.

In a preferred embodiment, in the first refining zone, the width of the ridges in the first refining zone is less than the width of the grooves in the first refining zone, and the width of the ridges in the second refining zone is greater than the width of the grooves in the second refining zone, so that an inverse relationship exists there-between.

In a preferred embodiment, the density of ridges in the first refining zone is greater than the density of ridges in the second refining zone. In another embodiment of the present invention, at least three such refining zones, preferably arcuate refining zones, are utilized. In this embodiment it is therefore preferred that the refining elements include the first refining zone, a second refining zone, and a third refining zone, all disposed in the direction of flow of the fibrous material through the refining element, each refining zone including both grooves and ridges, and the ratio of the width of the grooves in the first refining zone to the width of the ridges in the first refining zone is greater than the ratio of the width of the grooves in the second refining zone to the width of the ridges in the second refining zone, which, in turn, is greater than the ratio of the width of the grooves in the third refining zone to the width of the ridges in the third refining zone. In this embodiment, it is highly preferred that the width of the ridges in the first refining zone is less than the width of the grooves in the first refining zone; that the width of the ridges is equal to the width of the grooves in the second refining zone, and that the width of the ridges in the third refining zone is greate than the width of the grooves in the third refining zone.

Again, it is most highly preferred in this embodiment, including at least three refining zones, that the density of ridges in each succeeding refining zone be less than that of its preceeding refining zone.

DETAILED DESCRIPTION

Figure 1:
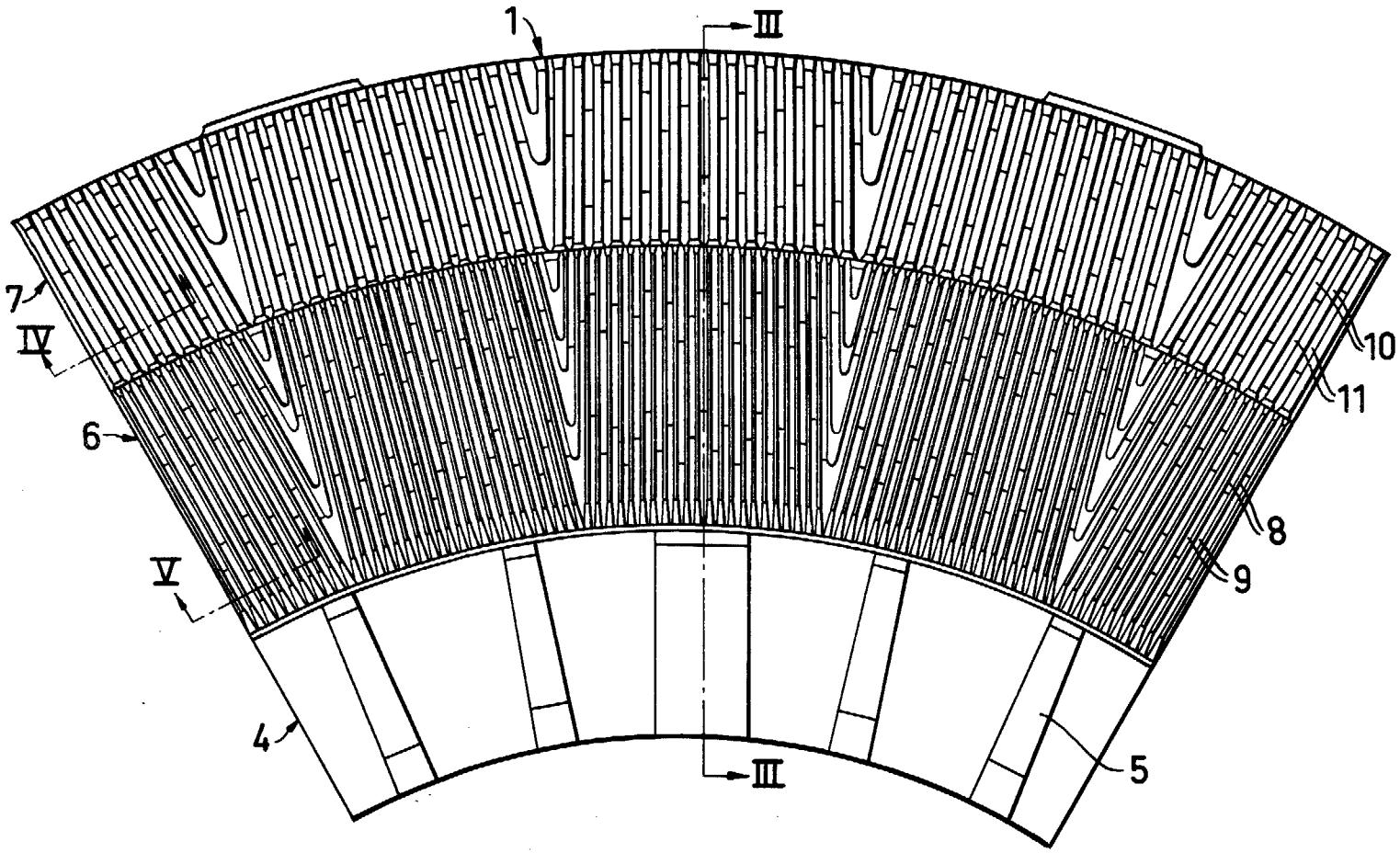
FIG. 1 shows a top elevational view of a refining element of the present invention.
Figure 2:
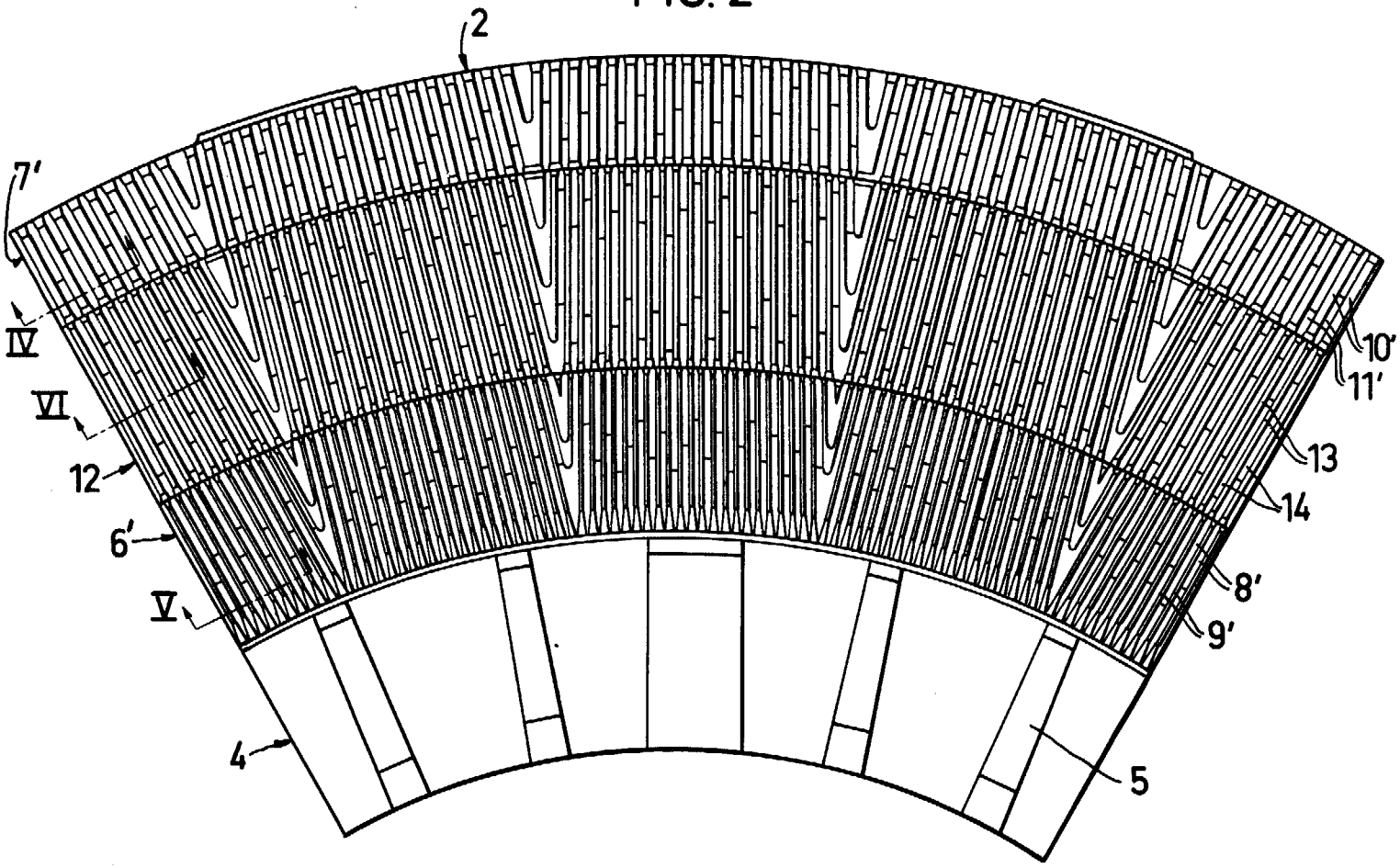
FIG. 2 shows a top elevational view of another refining element of the present invention.

Referring to the drawings, in which like numerals refer to like parts thereof, refining elements 1 and 2, respectively, as shown in FIGS. 1 and 2, respectively, are intended to be secured in a circular zone extending all around a circular disc-shaped holder in a disc refiner by means of bolts screwed into threaded holes 3, as shown in FIG. 3, in the rear surface of the refining elements. The refining elements 1 and 2 are provided with an inner feed zone 4, in which broad ridges 5 are thinly placed. Said zone 4 is substantially intended to feed the material out to the subsequent refining zones. A certain disintegration of the fibrous material, however, does take place in this feed zone.

According to FIG. 1, the feed zone 4 is followed by two refining zones 6 and 7. The inner refining zone 6 is provided with a pattern of ridges 8 and grooves 9 which are placed more densely than in the outer zone 7, i.e. the inner refining zone comprises more and narrower ridges than the outer refining zone.

In the inner refining zone 6, furthermore, the grooves 9 between the upper surfaces of the ridges 8 are wider than the width of said ridge surfaces 8, while in the outer refining zone 7 the relation between ridges 10 and grooves 11 is inverse.

In the inner refining zone 6, the fibrous material is substantially disintegrated to fiber by action of the compression forces. As the highest compression forces develop when the material is clamped between the edges of the ridges, the disintegration is more effective due to the denser pattern in the inner refining zone 6.

In the outer refining zone 7, a further treatment of the fiber, in order to further develop their paper-forming properties, takes place. This treatment, which is substantially effected by rubbing the material between the surfaces of the ridges, is rendered more efficient by the relatively broad surfaces of these ridges 10.

By this design of the refining zones, the paper-forming properties of the fiber material are developed very favorably, and refining to a pulp which is substantially ready for paper-making is facilitated in a single step.

According to FIG. 2, a refining element is provided with an additional refining zone 12, which is provided with ridges 13 and grooves 14, and which is located between the two refining zones 6' and 7' with ridges 8' and, respectively 10' and grooves 9' and, respectively, 11', which zones correspond to the refining zones 6 and 7 on the refining element shown in FIG. 1. The ridges 13 and gooves 14 in this refining zone have the same width, and the density of the pattern lies between the densities of the patterns in the refining zones 6' and 7'.

By this design of the refining elements a more successive disintegration and working of the fibrous material is obtained, which is highly desirable in certain cases.

While it is also possible to change the order of the refining zones, i.e. in such a manner that a refining zone with a denser pattern is placed outside of a refining zone with a thinner pattern, it is then important that the outermost refining zone have broader ridges than the ridges in at least one preceding refining zone, and that the ratio of the width of the ridges to the width of the grooves in that outermost refining zone be greater than the ratio of the width of the ridges to the width of the grooves in that preceding refining zone.

It may also be suitable to let the groove width decrease from one refining zone to the next in the direction of feed, because the transport forces increase outwards due to the centrifugal force, and the dimensions of the fibrous material decrease due to their being worked. If the grooves are too wide, moreover, the risk that shives in the material will pass out through the refining gap now rises.

It is also possible to design the last refining zone of the refining element entirely without depressions and to give the working surface a non-uniform and irregular micro-structure. This can be attained by means of chemical or mechanical treatment such as etching, electrolysis or grinding if a suitable alloy is used in the refining element.

The last refining zone may also be designed with a working surface which is provided with depressions which are not arranged strictly radially in rows, but which are spread over the surface in a more or less irregular pattern. In this manner, the fluxing material is forced to pass over the working surface so that it will be subjected to an effective rubbing. The depressions can thus have different sizes and shapes.

When the last refining zone has no grooves, it may be sufficient that one of two co-operating refining elements is of such design while the other element is provided with ridges and grooves, which would facilitate the steam transport through the refining gap. If, however, steam transport thereby will not become too difficult, the second refining element may also include a refining zone which is free from grooves.

The invention, of course, is not restricted to the embodiments described above, but can be varied within the scope of the claims.

What is claimed is:

1. A refining element for the refining of fibrous materials comprising a first refining zone and a second refining zone disposed in a direction of flow of said fibrous material through said refining element, an inner feed zone for feeding said fibrous material to said first refining zone and said second refining zone, respectively, both said first refining zone and said second refining zone including grooves and ridges thereon, the ratio of the width of said grooves to the width of said ridges in said first refining zone being greater than the ratio of the width of said grooves to the width of said ridges in said second refining zone, the width of said grooves in said first refining zone being greater than the width of said ridges in said first refining zone, the width of said grooves in said second refining zone being less than the width of said ridges in said second refining zone, the number of ridges in said first refining zone being greater than the number of ridges in said second refining zone, and the width of the grooves in said first refining zone being greater than the width of said grooves in said second refining zone.

2. The refining element of claim 1 wherein said refining element is adapted for use in a zone extending around a circular disc-shaped holder.

3. The refining element of claim 1 further including a third refining zone disposed intermediate said first and second refining zones including grooves and ridges disposed in the direction of flow of the said fibrous material through said refining element, wherein the ratio of the width of said grooves in said third refining zone to the width of said ridges in said third refining zone is intermediate the corresponding ratios for said first and second refining zones.

4. The refining element of claim 3 wherein the width of said grooves in said third refining zone is substantially equal to the width of said ridges in said third refining zone.

5. The refining element of claim 3 wherein the number of ridges in said first refining zone is greater than the number of ridges in said third refining zone, and the number of ridges in said third refining zone is greater than the number of ridges in said second refining zone.

6. The refining element of claim 3 wherein the width of the grooves in said first refining zone is greater than the width of said grooves in said third refining zone, and the width of said grooves in said third refining zone is greater than the width of said grooves in said second refining zone.

* * * * *